US005167329A

United States Patent [19]

Wilhite

[11] Patent Number: 5,167,329

[45] Date of Patent: Dec. 1, 1992

[54] FOLDABLE RACK

[75] Inventor: Gerald D. Wilhite, Duncanville, Tex.

[73] Assignee: Jokari/US, Inc., Carrollton, Tex.

[21] Appl. No.: 819,461

[22] Filed: Jan. 10, 1992

[51] Int. Cl.[5] ..... A47F 5/00

[52] U.S. Cl. ..... 211/49.1; 211/195

[58] Field of Search ..... 211/195, 49.1, 50, 200; 297/31, 55

[56] References Cited

U.S. PATENT DOCUMENTS

| | | | |
|---|---|---|---|
| 240,498 | 4/1881 | Bartell | 297/31 |
| 1,560,007 | 11/1925 | Weston | 211/200 X |
| 1,876,549 | 9/1932 | Bales | 297/55 X |
| 2,381,149 | 8/1945 | Wenneborg | 297/31 X |
| 3,094,357 | 6/1963 | Shwayder | 297/55 X |
| 3,360,226 | 12/1967 | Nicholas | 211/195 X |
| 4,390,204 | 6/1983 | Fleishman | 297/55 X |
| 4,887,725 | 12/1989 | VanNoord | 211/195 X |

*Primary Examiner*—Robert W. Gibson, Jr.
*Attorney, Agent, or Firm*—Dennis T. Griggs

[57] ABSTRACT

A foldable rack includes a load platform and side frame assembly for storing newspapers and magazines in a vertical stack. The load platform is coupled to the side frame assembly for rotation and retraction from an extended, load-bearing support position to a retracted, collapsed storage position in which the load platform is in substantial alignment with the side frame assembly. Rotation, extension and retraction of the load platform relative to the side frame assembly is accommodated by coupling pins which project from opposite sides of the load platform and which are received within longitudinal slots formed in the sidebars. The side frame assembly is stabilized by a pair of struts which are pivotally attached to the load platform and to the side frame assembly by semicylindrical clasps. The rack is foldable for compact, minimum profile storage by disengaging the clasps from the upper crossbar, and thereafter rotating the struts into alignment with the load platform while retracting the load platform into alignment with the side frame assembly.

15 Claims, 3 Drawing Sheets

FOLDABLE RACK

FIELD OF THE INVENTION

This invention relates generally to repository apparatus for accumulating sheet materials, and in particular to a foldable rack for storing newspapers and magazines in a vertical stack.

BACKGROUND OF THE INVENTION

Wastepaper recycling plays an important part in the conservation of natural resources and energy. However, a large fraction of newspapers and magazines which could be recycled are instead discarded or incinerated. Newspapers, magazines, and other wastepaper materials account for a substantial part of solid waste materials which are deposited in landfills. Most wastepaper materials could be recycled into other paper products, which would reduce landfill requirements and reduce the number of trees which must be cut to supply pulp to the paper manufacturing industry.

Because of the shortage of landfill space and the expense of wastepaper disposal, and because of the direct savings of natural resources and energy, wastepaper recycling has become mandatory in several jurisdictions. In other areas, voluntary efforts are underway for recycling wastepaper generated in the home and office. For example, the management of some large office towers provides wastepaper collection boxes for tenants, and collect the wastepaper and make it available to recycle agencies for pickup at a central location.

A vast amount of magazines and newspapers are delivered each day to private subscribers. Most newspapers are discarded daily, while most magazines are discarded weekly or monthly. Virtually all of the newspapers and most of the magazines are available for recycling.

DESCRIPTION OF THE PRIOR ART

Racks, tables and bookshelves have been provided for the temporary display of magazines and newspapers. Such furniture items have been designed for the primary purpose of displaying current magazines and newspapers, and make no provision for storage of out-of-date issues. It will be appreciated that for recycling to be successful in the home environment, such racks must not only be aesthetically pleasing, but must also have the capacity for long-term accumulation.

OBJECTS OF THE INVENTION

The principal object of the present invention is provide a rack having an aesthetically pleasing design and the capacity for long-term accumulation of newspapers, magazines and the like.

A related object of the invention is to provide a rack of the character described which is collapsible and foldable for minimum packaging size, thereby reducing storage volume, shipping volume and display space in a retail outlet.

Another object of the present invention is to provide a rack which is easy to set up and occupies minimum floor space when erected.

Yet another object of the present invention is to provide a rack having high load strength and stack capacity for newspapers, magazines and the like.

A related object of the invention is to provide a rack of the character described which is stable and will not sag or tip over when loaded.

A related object of the invention is to provide a rack of the character described which accommodates balanced stack loading for newspapers, magazines and the like, and which maintains stacked alignment without spillage.

A related object of the present invention is to provide a rack of the character described which accommodates bundling and unloading of stacked newspapers and/or magazines.

A further object of the present invention is to provide a rack of the character described which accommodates long-term collection of newspapers, magazines and the like in a flat, vertical stack, with the stacked items being accessible on all sides, and with the most recently stacked item being visible and fully displayed.

Still another object of the present invention is to provide a newspaper/magazine rack of the character described which can be moved about as necessary to accommodate floor cleaning/vacuuming.

SUMMARY OF THE INVENTION

The foregoing objects are achieved according to the present invention by a rack assembly which includes a load platform which is coupled to a side frame assembly for rotation and retraction from an extended, load-bearing support position in which the load platform projects transversely with respect to the side frame assembly to a retracted, collapsed storage position in which the load platform is in substantial alignment with the side frame assembly. In the preferred embodiment, the side frame assembly includes first and second sidebars and first and second crossbars interconnected in the form of a quadrilateral frame with the sidebars and crossbars framing an open window. A forward portion of the load platform projects through the open window, and a rear end portion slopes downwardly for engaging a floor surface. The forward end of the load platform rests on the lower crossbar of the side frame assembly.

Rotation, extension and retraction of the load platform relative to the side frame assembly is accommodated by coupling pins which project from opposite sides of the load platform and which are received within longitudinal slots formed in the sidebars. Forward extension movement of the load platform relative to the side frame assembly is limited by engagement of the load platform against the lower crossbar, and by engagement of the coupling pins against the sidebar slot sidewalls. The side frame assembly is stabilized by a pair of struts which are pivotally coupled to the upper crossbar and the load platform. Retraction movement of the load platform relative to the side frame assembly is limited by engagement of the struts against the rear end portion of the load platform, and by engagement of the coupling pins against the sidebar slot sidewalls. In the preferred embodiment, the load platform includes a rear crossbar, and the struts are pivotally attached to the rear crossbar of the load platform and to the upper crossbar of the side frame assembly by semicylindrical clasps. The rack is foldable for compact, minimum profile storage by disengaging the clasps from the upper crossbar, and thereafter rotating the struts into alignment with the load platform while retracting the load platform into coplanar alignment with the side frame assembly.

Other features and advantages of the present invention will be appreciated by those skilled in the art upon reading the detailed description which follows with reference to the attached drawings, wherein:

DETAILED DESCRIPTION OF THE PREFERRED EMBODIMENT

Figure 1:
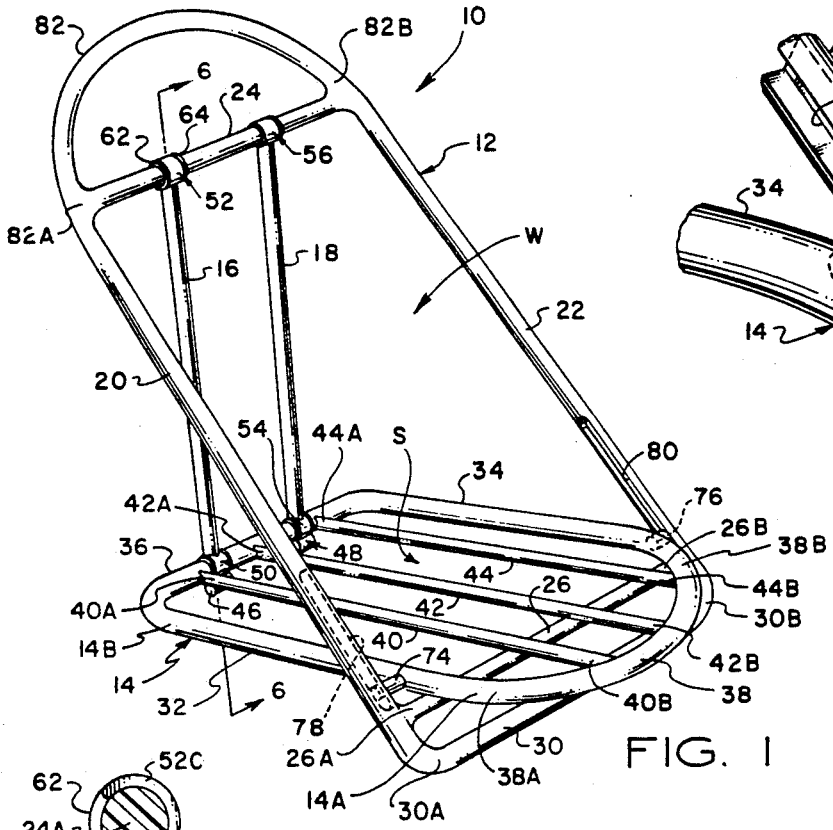
FIG. 1 is a front perspective view of a collapsible magazine/newspaper rack which is constructed according to the teachings of the present invention.

In the description which follows, like parts are marked throughout the specification and drawings with the same reference numerals, respectively. The drawings are not necessarily to scale, and the proportions of certain parts have been exaggerated to better illustrate details and features of the invention.

Figure 2:
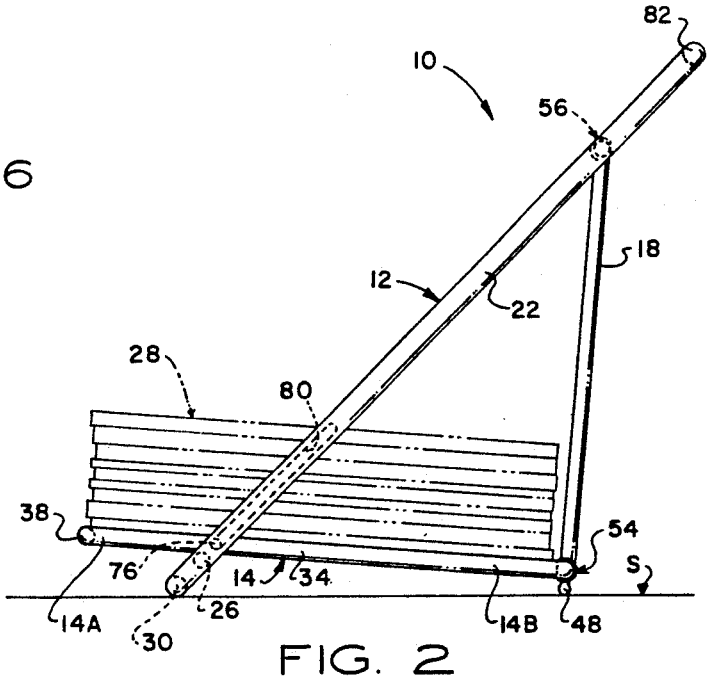
FIG. 2 is a right side elevational view of the rack assembly, with the broken lines indicating a stack of newspapers.

Referring now to FIG. 1 and FIG. 2 of the drawings, a rack assembly 10 for accumulating newspapers, magazines and the like is illustrated in an upright position of use. The rack assembly 10 includes a side frame assembly 12, a load platform 14, and first and second struts 16, 18 The side frame assembly 12 includes first and second sidebars 20, 22 and first and second crossbars 24, 26 interconnected in the form of a closed frame with the sidebars and crossbars framing a window opening W. Preferably, the closed frame provides a substantially rectangular window opening which will permit the placement of sheet materials 28, for example newspapers, magazines and the like, on the platform 14 and as shown in FIG. 2.

Figure 7:
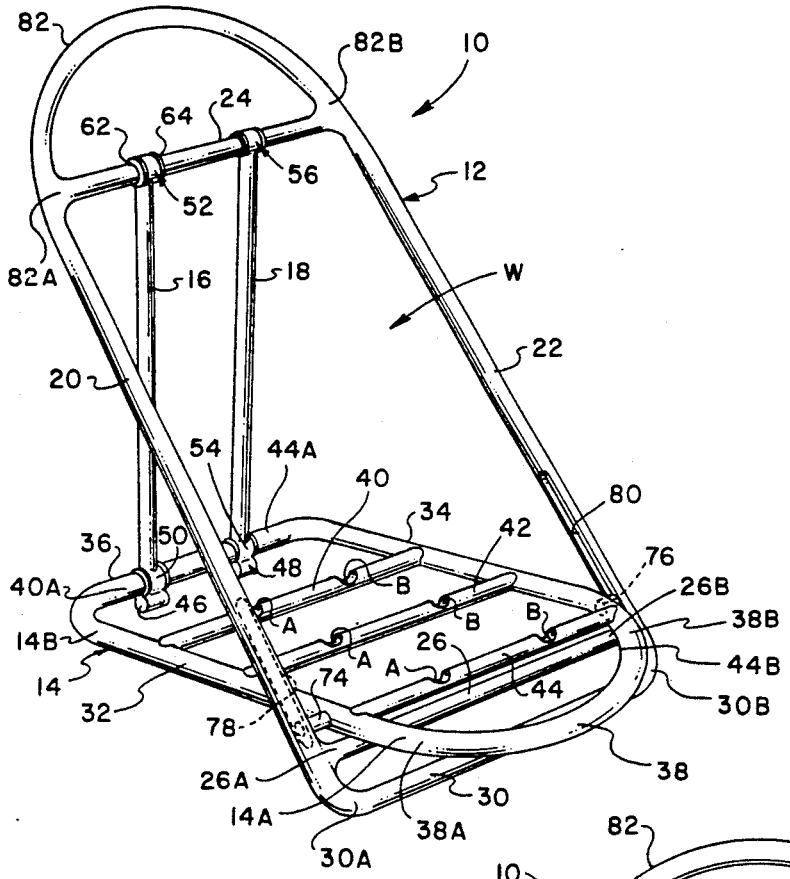
FIG. 7 is a front perspective view similar to FIG. 1 which illustrates a collapsible magazine/newspaper rack which is constructed according to an alternative embodiment of the present invention; and, FIG. 8 is a top plan view of the rack assembly shown in FIG. 7 after it has been folded and fully collapsed.
Figure 8:
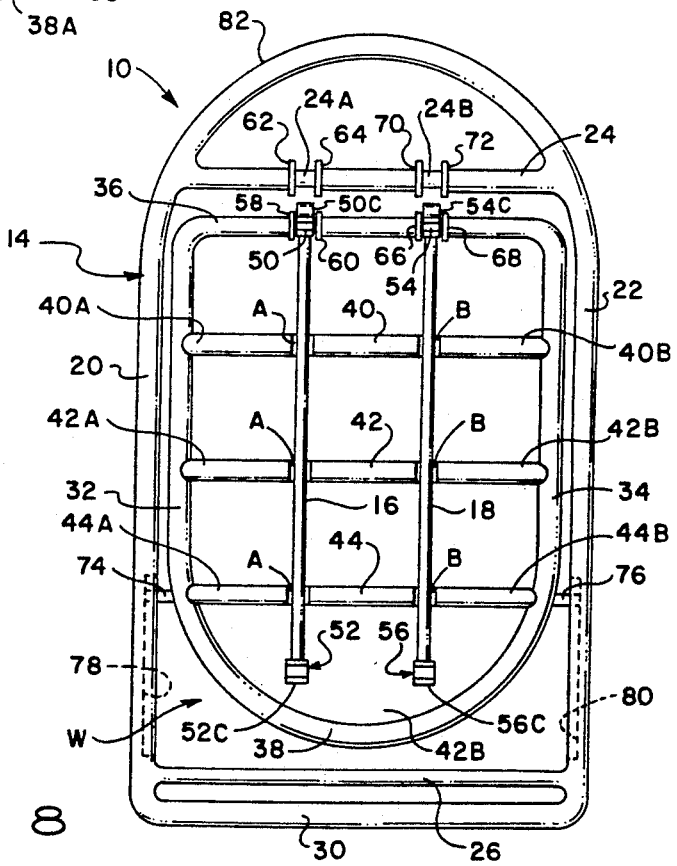

The side frame assembly 12 includes a base crossbar 30 which is adapted for engaging a floor surface in the upright position of use. The base bar 30 has opposite end portions 30A, 30B interconnected with the first and second sidebars 20, 22, respectively. Likewise, the intermediate crossbar 26 has its opposite end portions 26A, 26B interconnected with the sidebars 20, 22, respectively. In this arrangement, the intermediate crossbar 26 provides load-bearing support for the forward end portion 14A of the load platform, which also holds the forward end portion of the load platform at an elevated position above the floor surface S. The load platform 14 is formed by first and second sidebars 32, 34, a rear crossbar 36, and a forward crossbar 38. The sidebars 32, 34 and crossbars 36, 38 are interconnected to form a closed frame about a platform window opening S. Load support bars 40, 42 and 44 extend across the platform window opening S and are connected to the rear crossbar 36 and the forward crossbar 38, respectively. In this arrangement, the load support bars 40, 42 and 44 extend transversely with respect to the support crossbar 26. While the arrangement shown in FIG. 1 is preferred, in an alternative embodiment shown in FIG. 7 and FIG. 8, the load support bars 40, 42 and 44 extend in parallel with the forward support bar 26, and are interconnected at their opposite end portions to the platform sidebars 32, 34, respectively. In the alternative embodiment, it is preferred that the load support bars 40, 42 and 44 have laterally spaced recess or indentations A, B which are aligned for receiving the struts 16, 18 in coplanar engagement so that a minimum profile configuration can be achieved. The opposite end portions of the load support bars are identified in FIG. 1 and FIG. 8 as 40A, 40B, 42A, 42B, and 44A, 44B.

The load platform 14 slopes downwardly from the support crossbar 26, with its rear end portion 14B being adapted for engaging the floor surface S. In the preferred embodiment as shown in FIG. 1, the rear crossbar 36 of the platform 14 is supported on the floor surface S by first and second skid bars 46, 48.

Figure 6:
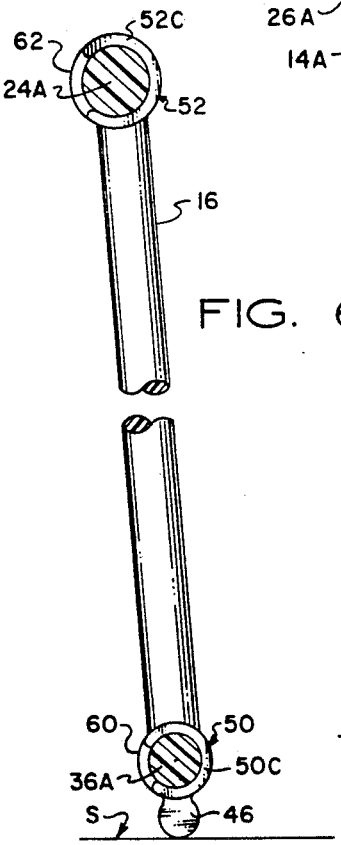
FIG. 6 is a sectional view taken along the line 6—6 of FIG. 1 showing the pivotal clasp coupling of a strut between the load platform and crossbar in FIG. 1.

The side frame assembly 12 is stabilized and maintained in a sloping position relative to the load platform 14 by the struts 16, 18. Each strut is pivotally interconnected at its opposite ends to the load platform rear crossbar 36 and the upper crossbar 24 of the upper side frame assembly by clasps 50, 52 and 54, 56, respectively. Referring to FIG. 6, each clasp has a semicylindrical clasping member, identified as 50C, 52C, 54C and 56C, respectively. Moreover, the rear crossbar 36 of the load platform and the upper crossbar 24 of the side frame assembly have spindle portions 36A, 36B and 24A, 24B, respectively, which are releasably engaged by the clasping members 50C, 52C and 54C, 56C, respectively. The clasping members are blocked against shifting movement along the spindle portions by radially projecting collars 58, 60; 62, 64; 66, 68; and 70, 72, respectively. According to this arrangement, the load platform 14 is pivotally coupled to the side frame assembly 12, which permits it to rotate relative to the side frame assembly while extending and retracting transversely through the window opening W.

Figure 5:
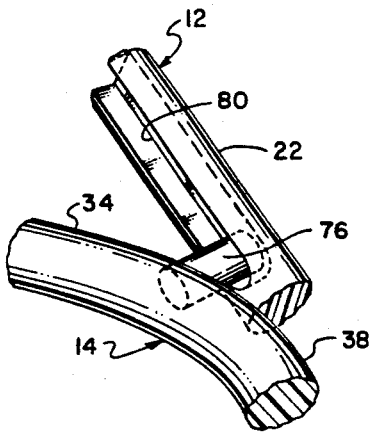
FIG. 5 is a perspective view, partially broken away, showing the pin coupling engagement between the load platform and side frame assembly of FIG. 1.

Referring now to FIG. 1 and FIG. 5, the load platform 14 is movably coupled to the side frame assembly 12 by pin bearing members 74, 76. Coupling pin 74 is attached to the sidebar 32 of the load platform 14 and coupling pin 76 is attached to the sidebar 34 of the load platform. The coupling pins 74, 76 project substantially at right angles with respect to the sidebars 32, 34, respectively. The sidebars 20, 22 of the side frame assembly 12 are intersected by longitudinal slots 78, 80. The coupling pins 74, 76 are received for sliding movement along the longitudinal slots 78, 80, respectively.

Figure 3A:
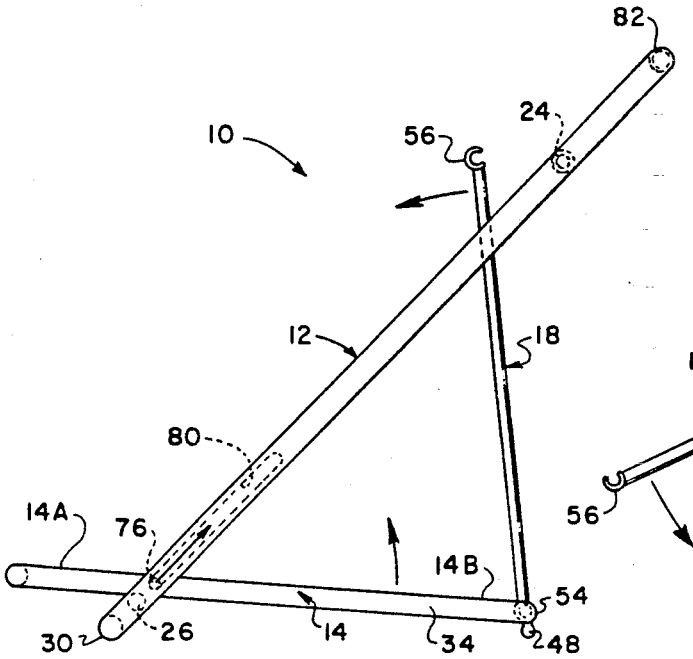
FIG. 3A, FIG. 3B and FIG. 3C are side elevational views which illustrate the movement and relative position of component parts of the rack as it is folded from an erect, accumulating position to a collapsed, minimum profile position.
Figure 3B:
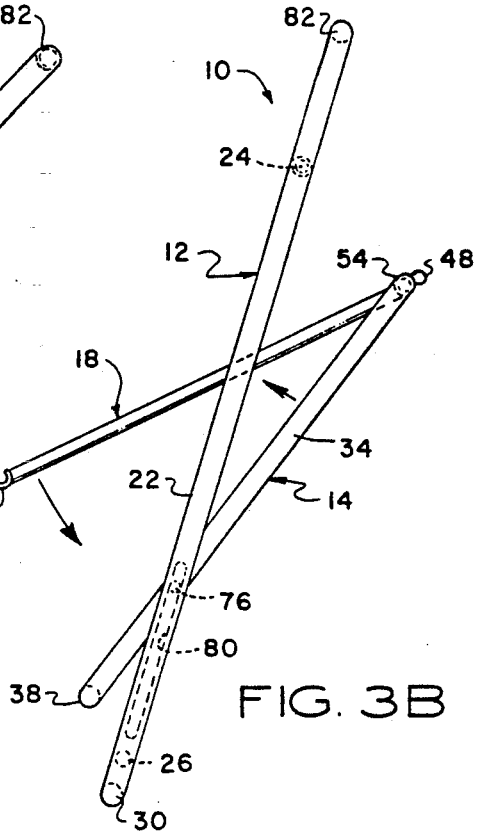
Figure 3C:
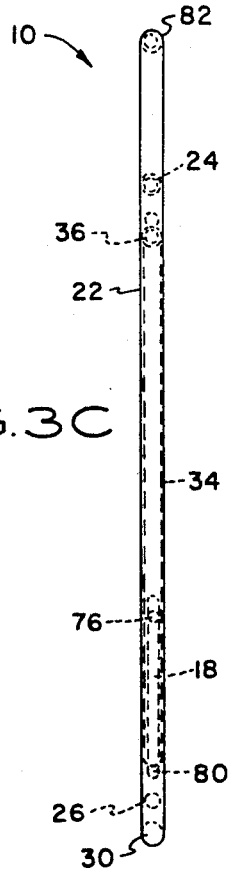
Figure 4:
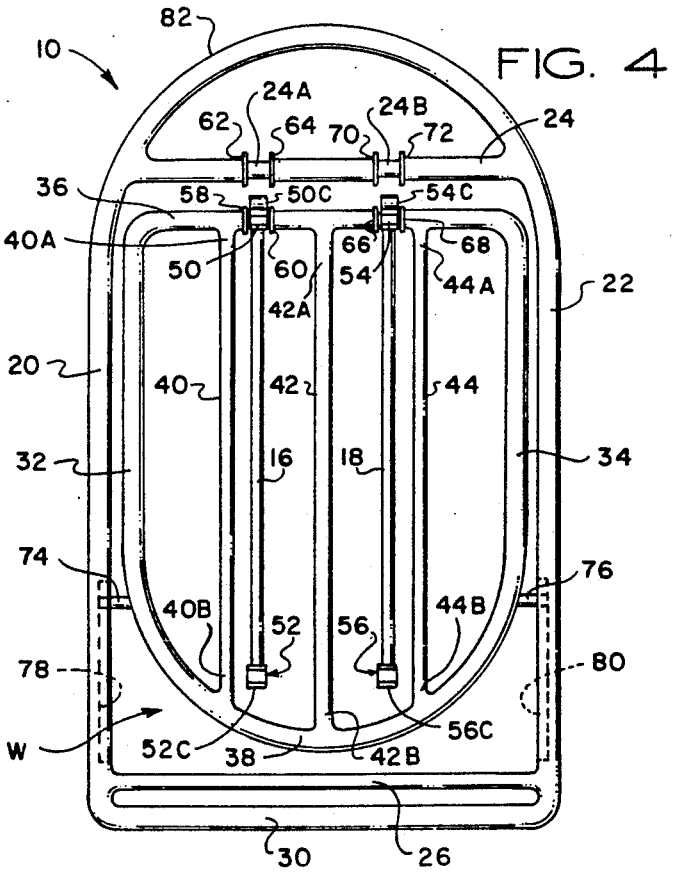
FIG. 4 is a top plan view of the rack assembly after it has been folded and fully collapsed.

The coupling pins 74, 76, when received within the longitudinal slots 78, 80, permit rotation and linear displacement of the load platform 14 relative to the side frame assembly 12. Referring to FIG. 3A, FIG. 3B, and FIG. 3C, the rack assembly 10 is foldable for compact, minimum profile storage by disengaging the clasps 52, 56 from the upper crossbar 24, and thereafter rotating the struts 16 18 into the window spaces between the load support bars 40, 42 and 44 until the struts are in coplanar alignment with the load support bars. Simultaneously, the load platform 14 is retracted along the sidebars 20, 22 until it is received within the open window space W, substantially in coplanar alignment with the sidebars 20, 22 of the side frame assembly 12, as shown in FIG. 3C and FIG. 4.

According to the foregoing arrangement, the bearing pins 74, 76 and slots 78, 80 which are formed in the sidebars 20, 22 of the side frame assembly permit simultaneous rotation and linear translation of the load platform 14 relative to the sidebar assembly 12. Because the struts stabilize the sidebar assembly with respect to the load platform, it is necessary to first release the engagement of the clasps on the upper ends of the struts 16, 18 from the upper crossbar 24 of the side frame assembly, and thereafter rotate them downwardly into alignment with the load platform support bars 40, 42 and 44. Upon release of the struts from the upper crossbar, the rear end portion 14B of the load platform is free to rotate inwardly toward the side frame assembly 12 until it is fully received within the window opening ii W as shown in FIG. 4. This permits the rack assembly 10 to assume a compact, minimum profile configuration, thereby minimizing packaging size, reducing storage volume, and minimizing the display space occupied by the packaged units in a retail outlet.

Preferably, all components of the rack assembly 10 are constructed of a durable, high strength ABS polymer material which is formed by injection molding.

The bearing pins 74, 76 limit linear translation of the load platform 14 relative to the side frame assembly by engagement of the pins against the sidebar slot sidewalls. The coupling pins 74, 76 permit the load platform 14 to travel along the sidebars 20, 22 until the forward end portion 14A of the load platform engages the support crossbar 26. Further extension of the load platform 14 is blocked by engagement of the forward end portion 14A against the support crossbar 26 and by engagement of the coupling pins 74, 76 against the crossbar sidewall of the longitudinal slots 78, 80.

It may be necessary to move the rack assembly 10 from time to time to accommodate floor cleaning/vaçuuming. For this purpose, the rack assembly 10 includes a top handlebar 82. The top handlebar 82 is attached to the sidebars 20, 22. As can best be seen in FIG. 1 and FIG. 4, the top handlebar 82 is a curved bar having the form of an arch connected at its opposite end portions 82A, 82B to the sidebars 20, 22. The arch portion of the curved bar 82 is separated from the upper crossbar 24, thereby providing hand grip access. Relocation of the rack assembly 10 is also accommodated by the forward crossbar 38 of the load platform 14. Preferably, the forward crossbar 38 is a curved bar having the form of an arch, with the opposite end portions 38A, 38B of the curved bar being connected to the sidebars 32, 34 of the load platform. The spaces between the load support bars 40, 42 and 44 provide hand grip access. The rack assembly 10 can be pulled forward by gripping the curved arch of the forward handle 38 and pulling the rack assembly forward, permitting the skid bars 46 to drag across the floor surface S.

It will be appreciated that the rack assembly 10 of the present invention may be shipped in a minimum profile, knocked-down configuration as shown in FIG. 4, and can be quickly set up into a position of use as shown in FIG. 1 and FIG. 2 merely by rotating the struts 16, 18 into engagement with the upper crossbar 24 and permitting the load platform 14 to drop into engagement with the support crossbar 26. The load platform 14 is stabilized and reinforced by the load support bars 40, 42 and 44 and the upright struts 16, 18, which provide high strength and stack capacity for long-term accumulation of newspapers, magazines and the like. Because the rack assembly 10 is supported by the forward base bar 30 of the side frame assembly 12 and the rear crossbar 36 of the load platform 14, the assembly 10 is stable and will not sag or tip when loaded. Moreover, the sidebars 20, 22 of the side frame assembly 12 provide lateral support for balanced loading of newspapers, magazines and the like, and maintain stacked alignment without spillage. The stacked items are accessible on all sides, which permits the stack to be wrapped and bundled for unloading.

Although the invention has been described with reference to a specific embodiment, the foregoing description is not intended to be construed in a limiting sense. Various modifications to the disclosed embodiment as well as alternative applications of the invention will be suggested to persons skilled in the art by the foregoing specification and illustrations. It is therefore contemplated that the appended claims will cover any such modifications, applications or embodiments which fall within the true scope of the invention.

What is claimed is:

1. A rack for accumulating sheet materials in a vertical stack comprising, in combination:

a side frame assembly including first and second sidebars and first and second crossbars interconnected in the form of a closed frame with said sidebars and crossbars framing a window opening, wherein one of said crossbars constitutes an upper crossbar and the other crossbar constitutes a lower crossbar when said rack is a in an upright position of use;

a load platform having a forward end portion projecting through said window opening transversely with respect to the sidebars and having a rear end portion adapted for engaging a floor surface;

a strut connecting the rear end portion of said load platform to said side frame assembly said strut having a first end portion pivotally coupled to the rear end portion of said load platform and having a second end portion releasably attached to the upper crossbar of said side frame assembly; and, coupling means connecting the forward end portion of said load platform to said side frame assembly for limiting movement of said load platform relative to said side frame assembly.

2. A rack for accumulating sheet materials in a vertical stack comprising, in combination:

a side frame assembly including first and second sidebars and first and second crossbars interconnected in the form of a closed frame with said sidebars and crossbars framing a window opening, wherein one of said crossbars constitutes an upper crossbar and the other crossbar constitutes a lower crossbar when said rack is in an upright position of use;

a load platform having a forward end portion projecting through said window opening transversely with respect to the sidebars and having a rear end portion adapted for engaging a floor surface;

a strut connecting the rear end portion of said load platform to said side frame assembly;

coupling means connecting the forward end portion of said load platform to said side frame assembly for limiting movement of said load platform relative to said side frame assembly; and, said coupling means including a longitudinal slot formed in one of said sidebars and a pin attached to said load platform, said pin projecting into said slot.

3. A foldable rack as defined in claim 1, including clasp means releasably interconnecting said strut to the rear end portion of said load platform and to the upper crossbar of said side frame assembly.

4. A foldable rack as defined in claim 3, wherein said clasp means comprises a first semicylindrical clasp attached to one end portion of said strut, the first semicylindrical clasp being coupled for pivotal movement to the rear end portion of said load platform, and a second semicylindrical clasp attached to the opposite end portion of said strut, the second semicylindrical clasp being pivotally coupled to said upper crossbar.

5. A foldable rack as defined in claim 4, wherein the rear end portion of said load platform comprises a crossbar, said crossbar having a spindle portion and first and second radially projecting collars spaced apart on said spindle portion, the first semicylindrical clasp being pivotally coupled to said spindle portion between said first and second collars; and, wherein said upper crossbar having a spindle portion and first and second radially projecting collars spaced apart on said spindle portion, said second semicylindrical clasp being pivotally coupled to the spindle portion of said upper crossbar between the first and second collars.

6. A foldable rack as defined in claim 1, said side frame assembly including a base bar interconnected with said first and second sidebars, said base bar being disposed substantially in parallel alignment with said lower crossbar and being spaced therefrom, said base bar being adapted for engaging a floor surface.

7. A foldable rack as defined in claim 1, including a top handlebar interconnected with said first and second sidebars, said top handlebar being longitudinally spaced with respect to said top crossbar, wherein said top handlebar comprises a curved bar having the form of an arch connected at its opposite end portions to said first and second sidebars.

8. A foldable rack as defined in claim 1, wherein said load platform including a plurality of frame members interconnected to form a closed frame, said frame members including first and second sidebars and first and second crossbars framing a window opening, said load platform including at least one support bar extending across said window opening and having opposite end portions connected to a selected pair of said load platform frame members, respectively, and said at least one support bar being connected at its opposite end portions to the rear crossbar and to the forward crossbar of said load platform, respectively.

9. A foldable rack as defined in claim 1, wherein said load platform including a plurality of frame members interconnected to form a closed frame, said frame members including first and second sidebars and first and second crossbars framing a window opening, said load platform including at least one support bar extending across said window opening and having opposite end portions connected to a selected pair of said load platform frame members, respectively, and said at least one support bar being connected at its opposite end portions to the first sidebar and to the second sidebar of said load platform, respectively.

10. A collapsible rack for accumulating sheet materials in a vertical stack comprising, in combination:

a side frame assembly including first and second sidebars and first and second crossbars interconnected in the form of a closed frame with said sidebars and crossbars framing a window opening, wherein one of said crossbars constitutes an upper crossbar and the other crossbar constitutes a lower crossbar when said rack is in an upright position of use;

a load platform having a forward end portion projecting through said open window transversely with respect to the sidebars and having a rear end portion adapted for engaging a floor surface;

a strut having first and second end portions pivotally connected to the rear end portion of said load platform and pivotally connected to the upper crossbar of said side frame assembly, respectively; and, coupling means connecting the forward end of said load platform to said side frame assembly, said coupling means permitting rotation and linear movement of said load platform relative to said side frame from an extended, load-bearing support position in which said load platform projects transversely with respect to said frame to a retracted, collapsed position in which said load platform is disposed within said open window substantially in coplanar alignment with said side frame assembly.

11. A collapsible rack as defined in claim 10, said coupling means comprising a first longitudinal slot formed in said first sidebar and a second longitudinal slot formed in said second sidebar; and, a first pin attached to the forward end portion of said load platform and a second pin attached to the forward end portion of said load platform, said first and second pins projecting transversely with respect to said load platform on opposite sides thereof, and said first and second pins projecting into said first and second longitudinal slots, respectively.

12. A collapsible rack as defined in claim 10, including load-bearing means attached to said side frame assembly, said load-bearing means engaging and supporting the forward end portion of said load platform in the upright position of use.

13. A collapsible rack as defined in claim 12, wherein said load-bearing means comprises said lower crossbar.

14. A collapsible rack as defined in claim 10, said side frame assembly including a base bar interconnected with said first and second sidebars, said base bar being disposed substantially in parallel alignment with said lower crossbar and being spaced therefrom, said base bar being adapted for engaging a floor surface.

15. A rack for accumulating sheet materials in a vertical stack comprising, in combination:

a load platform having a forward end portion for projecting through a window opening and having a rear end portion adapted for engaging a floor surface;

a side frame assembly including first and second sidebars and first and second crossbars interconnected in the form of a closed frame with said first and second sidebars and first and second crossbars framing a window opening, with one of said crossbars constituting an upper crossbar and the other crossbar constituting a base bar for engaging a floor surface in an upright position of use, and including a third crossbar disposed intermediate the upper crossbar and base bar, said third crossbar extending transversely across the window opening substantially in parallel relation with said base bar, said third crossbar having first and second end portions connected to the first and second sidebars, respectively, and said third crossbar engaging and supporting the forward end portion of said load platform in the upright position of use;

a strut connecting the rear end portion of said load platform to the upper crossbar of said side frame assembly; and, coupling means connecting the forward end portion of said load platform to said side frame assembly for limiting extension and retraction of said load platform relative to the third crossbar.

* * * * *